US011925847B2

(12) United States Patent
Gotthelf et al.

(10) Patent No.: US 11,925,847 B2
(45) Date of Patent: Mar. 12, 2024

(54) SKI-RIGHT SKI TRAINER

(71) Applicants: Philip Gotthelf, Closter, NJ (US); John C. Tomaini, Warwick, NY (US)

(72) Inventors: Philip Gotthelf, Closter, NJ (US); John C. Tomaini, Warwick, NY (US)

( * ) Notice: Subject to any disclaimer, the term of this patent is extended or adjusted under 35 U.S.C. 154(b) by 0 days.

(21) Appl. No.: 17/148,806

(22) Filed: Jan. 14, 2021

(65) Prior Publication Data

US 2021/0213343 A1 Jul. 15, 2021

Related U.S. Application Data

(60) Provisional application No. 62/960,841, filed on Jan. 14, 2020.

(51) Int. Cl.
*A63B 69/18* (2006.01)

(52) U.S. Cl.
CPC ..... *A63B 69/18* (2013.01); *A63B 2214/00* (2020.08); *A63B 2225/09* (2013.01); *A63B 2225/093* (2013.01); *A63B 2244/19* (2013.01)

(58) Field of Classification Search
CPC ..... A63B 69/18; A63B 69/0057; A63B 2225/093; A63B 2225/09; A63B 2244/12; A63B 2244/18; A63B 2244/19; A63B 2244/22; A63B 2071/0655; A63B 2208/0204; A63B 2208/12; A63B 2214/00
See application file for complete search history.

(56) References Cited

U.S. PATENT DOCUMENTS 3,529,819 A * 9/1970 Blank ..... A47D 13/04 482/68
5,120,227 A * 6/1992 Born ..... A63C 11/22 135/66
5,378,156 A * 1/1995 Rohe ..... A63B 69/18 434/253
6,592,377 B2 * 7/2003 Bendele, Jr. ..... A63C 5/16 482/71
8,574,136 B1 * 11/2013 Burstrom ..... A63B 21/0724 482/109

(Continued)

*Primary Examiner* — John E Simms, Jr.
(74) *Attorney, Agent, or Firm* — Brian L. Wamsley; Ware, Fressola, Maguire & Barber LLP

(57) ABSTRACT

A multi-dimensional adjustable device for use in training skiers is disclosed. The ski training device of the present invention provides a horizontal support bar having a cushioned proximal end for comfortably engagement with a skier's chest and an opposite, distal end which can be gripped by a ski instructor. Specifically, a pair of adjustable upward-facing handles is positioned on the support bar to be gripped by the skier after the width between the handles is adjusted in accordance with the width of the skier's shoulders, and after the pair of handles is adjustably positioned along the length of said support bar in accordance with the length of the skier's arms. In this manner, skier leans forward in a proper skiing position. The distal end of the support bar provides a hand grip for the instructor. Also, an additional grip is adjustably positioned near the distal end, which provides an alternative grip for the instructor. In use, the skier is guided by a trained ski instructor or individual who directs the learning skier into turns, stops, and starts, while the skier is leaning forward, and properly faces the skier downhill in the "fall line" direction.

2 Claims, 2 Drawing Sheets

(56) References Cited

U.S. PATENT DOCUMENTS

| | | | | |
|---|---|---|---|---|
| 2002/0165037 | A1* | 11/2002 | Stitz | A63B 69/36213 473/260 |
| 2006/0223681 | A1* | 10/2006 | Loane | A63B 22/16 482/71 |
| 2013/0157237 | A1* | 6/2013 | Davis | A63C 5/16 434/253 |
| 2014/0272857 | A1* | 9/2014 | Winder | A63B 69/18 434/253 |
| 2019/0168097 | A1* | 6/2019 | Lo | A63B 21/05 |
| 2021/0101063 | A1* | 4/2021 | Sudit | A63C 11/2228 |

* cited by examiner

SKI-RIGHT SKI TRAINER

This application claims the benefit of U.S. provisional patent application Ser. No. 62/960,841, filed Jan. 14, 2020.

BACKGROUND

Skiing is a sport and major recreational activity enjoyed by many around the world. However, learning to ski can be challenging and ski instructors are continually searching for new or improved methods for teaching skiing. Part of the challenge is learning a proper skiing stance such that it provides balance to the skier and while imparting the ability to control and steer the skis. Maintaining the optimal position over the skis by the skier is thus paramount in the very beginning of learning how to ski. Accordingly, a need exists for a method or a device that holds the skier in the proper skiing position over his/her skis while they are learning to ski. Such device would impart the proper forward lean to the skier, which leads to the correct weighting of the skis for steering, and also holds the skier's arms and hands in the correct position for holding ski poles.

SUMMARY OF THE INVENTION

The ski trainer contemplated according to the present invention provides a device that departs substantially from the conventional ski-teaching concepts and methods taught and used in the prior art. In so doing, it provides a ski trainer primarily designed to provide positional stability to a ski student from the beginning of the student's ski lessons while also providing direct interaction with the ski student and the ski instructor.

It is therefore an object of the present invention to provide a ski training device specifically designed to place and hold the skier in the proper forward leaning skiing position while learning to ski. It is further an object of this invention to provide a ski training device that is comfortable to the skier, and is adjustable to the skier's physical dimensions, such as height, shoulder width and arm length. In that regard, it is an object of this invention to provide a ski training device having a comfortable physical connection with the skier and to which the skier can grasp in the proper hand position for holding ski poles. It is a further object of this invention to provide a ski training device which can be controlled by the ski instructor, or other person assisting the skier in learning to ski, such that the ski instructor can direct the ski student in a desired skiing direction, such as for doing turns and for skiing down the fall line.

Thus, the present invention provides a ski training device that accelerates learning how to ski by automatically positioning an individual into the proper forward "skier's" stance. The Ski-Right™ ski trainer comprises a fully adjustable and multi-dimensional support bar which allows the skier to lean on a bar or block just below the pectoral muscles. At the same time, upward handles are held to simulate the proper position for holding the ski poles. These handles can be adjusted forward or backward along the pole rod to accommodate individuals with different arm lengths and can be widened or narrowed to adjust for different shoulder widths. Adjustment ranges are sufficient to match children as young as four years up to all sizes of adults. The adjustment dimensions include arm length, shoulder and chest width, and chest height. All adjustments are made quickly and easily using alignment holes and locking pins. The extended, distal end of the support bar is held and guided by a trained ski instructor or individual who directs the learning skier into turns, stops, and starts while allowing the learner to lean forward and properly face downhill in the "fall line" direction.

BRIEF DESCRIPTION OF THE DRAWINGS

The methods, features, objects, and advantages according to the invention will appear and can be further understood and described in more detail with regard to the accompanying figures. The figures illustrate ways of implementing the present invention and are not to be construed as being limiting to other possible embodiments falling within the scope of the attached claims.

DETAILED DESCRIPTION OF THE INVENTION

Reference is made to the drawings FIGS. 1-4 for a description of the preferred embodiments of the present invention wherein like reference numbers represent identical elements on corresponding views.

Figure 1:
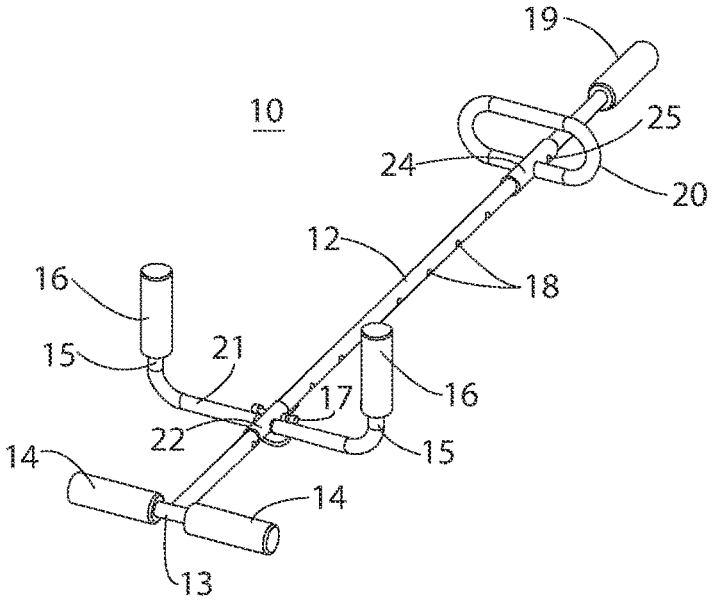
FIG. 1 is a perspective view of an embodiment of the ski trainer of the present invention.

Referring now to the drawings, FIG. 1 is a perspective view of a preferred embodiment of the present invention which is a ski trainer 10 which comprises a fully adjustable and multi-dimensional support bar 12 having a block or horizontal bar 13 at a proximal end which the skier positions on his or her chest just below the pectoral muscles and on which the skier leans. In this embodiment, support bar 12 is a hollow, round tube which may be fabricated from metal, such as aluminum, plastic, carbon fiber or the like. Support bar 12 can also comprise different shapes other than a round tube such as a square or oval tube or solid bar or rod, although a hollow bar is preferred to reduce weight. In a preferred embodiment, support bar 12 is about 48-50 inches in length which accommodates most typical size skiers, although it may be longer or shorter, particularly so the ski trainer 10 may be adjusted for shorter skiers and children. Support bar 12 further comprises a series of lateral adjustment holes 18, which are evenly spaced-apart for providing adjustment of upward-facing handles 15 and handgrip 20 along the length of support bar 12. Accordingly, adjustment holes 18 are located along the length of support bar 12 at intervals of about 3 inches, although other interval distances can be used.

The proximal end of support bar 12, the end which comes into contact with the learning skier, comprises, in a preferred embodiment, horizontal bar 13 having pads or cushions 14 at each of its ends to provide comfort to the skier at this point of contact. In use, horizontal bar 13 is positioned just below the pectoral muscles of the skier, so that the skier is comfortably able to lean on bar 13. Horizontal bar 13 is constructed of the same material and manner as is support bar 12. A pair of upward-facing handles 15, which simulate the proper position for holding ski poles, are spaced forward from horizontal bar 13 along support bar 12 to be gripped by the skier. Upward handles 15 are comprised of a horizontal spacer 21 (FIGS. 1 and 2) having the upward handles 15 vertically located at each end. Upward handles 15 are constructed in the same manner as support 12, are comprised of handgrips 16 and sleeve 22, and are slidable either forward or backward along support bar 12 to accommodate skiers with different arm lengths. Thus, upward handles 15 are easily re-positioned by sliding sleeve 22 along support bar 12 using adjustment holes 18 and locking pin 17. Sleeve 22, which may be about 4 inches in length, also comprises an alignment hole 23 which corresponds to adjustment holes 18, for accommodating locking pin 17 in securing upward handles 15 in a selected position. Handles 15 and handgrips 16 are held by the skier to simulate the proper position for the skier to hold ski poles in actual skiing when the ski trainer is no longer needed. Further, upward handles 15 are adjustable, and can be widened or narrowed to adjust for different shoulder widths. Adjustment ranges are sufficient to match children as young as four years up to all sizes of adults. The adjustment dimensions include arm length, shoulder and chest width, and chest height. All adjustments are made quickly and easily using alignment holes 23 and locking pins 17 (see FIG. 2) in the same manner as shown on support bar 12. The distance 26 (see FIG. 4) between upward handles 15 may range from about 12 inches to a maximum of about 18 inches, depending on the dimensions of the skier.

Figure 2:
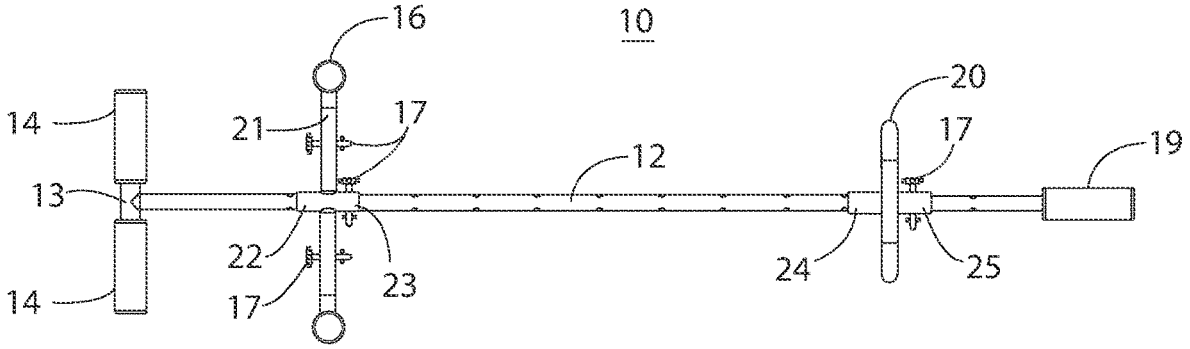
FIG. 2 is a top view of the ski trainer of FIG. 1.
Figure 3:
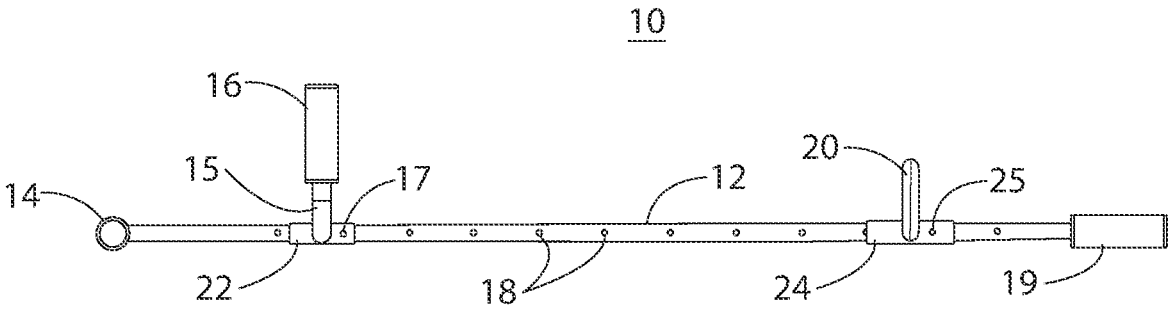
FIG. 3 is a side view of the ski trainer of FIG. 1.

Referring now to FIGS. 2 and 3, which are a top view and side view respectively of the invention, support bar 12 further comprises handgrip 19 at its distal end opposite horizontal bar 13 for a skier instructor or other individual assisting the learning skier. Handgrip 19 is used by the ski instructor to direct the skier in a particular direction and/or to pull the skier in a forward direction. In addition, in one embodiment, an adjustable oval handgrip 20 is provided near the distal end of support bar 12. Similar to upward handles 15, oval handgrip 20 comprises sleeve 24, which is about 4 inches in length, such that oval handgrip 20 is slidably movable along support bar 12 and secured using alignment hole 25 in sleeve 24 and locking pin 17 (FIG. 2). Oval handgrip 20 is an alternative handgrip for use by the instructor to guide the skier. Although oval handgrip 20 comprises an oval shape as seen in FIGS. 1 and 4, the invention contemplates that other shapes, such as circular or elliptical, could be used.

Figure 4:
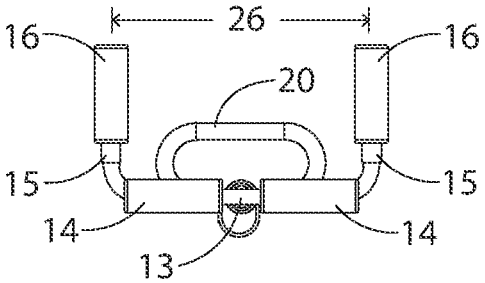
FIG. 4 is a proximal end view of the ski trainer of FIG. 1.

FIG. 4 is an end view of the proximal end of the ski trainer as would be seen by the skier. As shown, upward handles 15 are spaced apart at a selected distance 26. Also, oval handgrip 20 is seen from this view.

In use, ski trainer 10 is first fitted to the skier by adjusting distance 26 between upward facing handles 15 to suit the skier, and positioning handles 15 along support rod 12. The proper distance from the skier's chest for upward handles 15 is measured mostly by the length of the skier's forearm, taking into consideration that the forearm may be extended from the body in simulation of using ski poles. Once upward handles 15 are properly positioned, the skier engages handgrips 16 and places bar 13 against his or her chest comfortably below the pectoral muscles. This positions the learning skier to lean forward in the proper position. Grip 19 at the distal end of support bar 12 is held and guided by a trained ski instructor or individual who directs the learning skier into turns, stops, and starts, while the learner is leaning forward, and properly faces the skier downhill in the "fall line" direction.

The preceding preferred embodiments are illustrative of the practice of the invention. It is to be understood, however, that other expedients known to those of skill in the art, or disclosed herein, may be employed without departing from the spirit of the invention or the scope of the claims.

What is claimed is:

1. A method for providing ski instruction while placing and holding a ski student in a proper forward leaning skiing position and in a proper hand position for holding ski poles, said method comprising the steps of:

engaging a ski training device between a ski student and a skiing instructor, said ski training device comprising;

a horizontal support rod having a proximal end for engagement with said ski student at said ski student's chest, and a distal end for engagement with said ski instructor;

a horizontal bar positioned at said proximal end of said horizontal support rod, said horizontal bar comprising two ends and being cushioned for being placed in contact with said ski student's chest slightly below the pectoral muscles; a handle assembly that simulates the proper position for holding ski poles, said handle assembly being adjustably positioned horizontally on said horizontal support rod forward from said proximal end of said horizontal support rod, said handle assembly comprising a pair of upward facing handles positioned to be gripped by said ski student, said pair of upward-facing handles being adjustably spaced apart from about 12" to about 18," to correspond to the width of said ski student's shoulders;

a fixed handgrip positioned at said distal end of said horizontal support rod, for engagement by said ski instructor, an upward facing oval handgrip adjustably positioned on said horizontal support rod forward from said distal end of said support rod for alternative engagement by said ski instructor;

adjusting said ski training device to said ski student, said adjusting comprising the steps of;

lateral adjustment of said upward facing handles to approximate the width of said ski student's shoulders, positioning said upward facing handles along said horizontal support rod forward from said ski student such that the ski student is required to lean forward into a proper ski stance;

engaging said ski training device by said ski student whereby said ski student first grasps said upward facing handles and then places the horizontal bar in a position on said ski student's chest slightly below said ski student's pectoral muscles;

engaging said ski training device by said ski instructor by grasping said fixed handgrip or said upward facing oval handgrip; and guiding said ski student down a ski slope by said ski instructor and into turns, stops and starts while said ski student is held in a proper forward leaning ski position.

2. The method of claim 1, wherein said upward facing handles are positioned forward from said ski student at a distance at least corresponding to the length of said ski student's forearms.

* * * * *